US008824942B2

(12) United States Patent
Ishida et al.

(10) Patent No.: US 8,824,942 B2
(45) Date of Patent: Sep. 2, 2014

(54) FIXING DEVICE AND IMAGE FORMING APPARATUS

(75) Inventors: Masami Ishida, Kanagawa (JP); Shigeru Watanabe, Kanagawa (JP); Kiichirou Arikawa, Kanagawa (JP); Yoshiro Konishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 118 days.

(21) Appl. No.: 13/559,169

(22) Filed: Jul. 26, 2012

(65) Prior Publication Data

US 2013/0251418 A1 Sep. 26, 2013

(30) Foreign Application Priority Data

Mar. 26, 2012 (JP) ..... 2012-069243

(51) Int. Cl.
*G03G 15/20* (2006.01)

(52) U.S. Cl.
USPC ..... 399/328

(58) Field of Classification Search
CPC ..... G03G 21/1857; G03G 15/1615; G03G 15/757; G03G 21/186; G03G 15/0935; G03G 15/00; G03G 15/20; G03G 21/1657; G01G 2221/1657
USPC ..... 399/328; 403/359.2, 359.6, 298, 354, 403/375, 356; 464/16, 73–76, 159, 157, 464/158
See application file for complete search history.

(56) References Cited

U.S. PATENT DOCUMENTS 7,127,203 B1 * 10/2006 Pitts ..... 399/328

FOREIGN PATENT DOCUMENTS

| | | | |
|---|---|---|---|
| JP | 63-293575 | A | 11/1988 |
| JP | 09-281834 | A | 10/1997 |
| JP | 2005-182015 | A | 7/2005 |
| JP | 2005-182023 | A | 7/2005 |

* cited by examiner

*Primary Examiner* — David Gray
*Assistant Examiner* — Sevan A Aydin
(74) *Attorney, Agent, or Firm* — Sughrue Mion, PLLC

(57) ABSTRACT

A fixing device includes a cylindrical rotating member rotating in a circumferential direction thereof and having a slot at an end thereof and a protruding section extending along an edge of the slot at a front side in a rotational direction of the rotating member, the rotating member receiving a rotational driving force via the slot; a pressing member pressing a recording medium bearing an unfixed toner image on a surface thereof by nipping the recording medium together with the rotating member so as to fix the toner image onto the surface; a heat source heating the recording medium; and a driving member having an engagement section engaged with the slot and in contact with the protruding section at a position separated from a peripheral wall of the cylinder by a certain distance, the driving member imparting the rotational driving force to the rotating member via the engagement section.

8 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-069243 filed Mar. 26, 2012.

BACKGROUND

Technical Field

The present invention relates to fixing devices and image forming apparatuses.

SUMMARY

According to an aspect of the invention, there is provided a fixing device including a rotating member, a pressing member, a heat source, and a driving member. The rotating member has a shape of a cylinder and rotates in a circumferential direction of the cylinder. The rotating member has a slot at an end of the cylinder and a protruding section extending along an edge of the slot at a front side in a rotational direction of the rotating member. The rotating member receives a rotational driving force via the slot. The slot extends through the cylinder from an inside to an outside thereof and also extends from the end toward a center of the cylinder. The protruding section protrudes in a direction that intersects a peripheral wall of the cylinder. The pressing member presses a recording medium bearing an unfixed toner image on a surface thereof by nipping the recording medium together with the rotating member so as to fix the toner image onto the surface. The heat source heats the recording medium nipped between the rotating member and the pressing member. The driving member has an engagement section that is engaged with the slot in the rotating member and is in contact with the protruding section at a position separated from the peripheral wall of the cylinder by a certain distance. The driving member imparts the rotational driving force to the rotating member via the engagement section.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Figure 1:
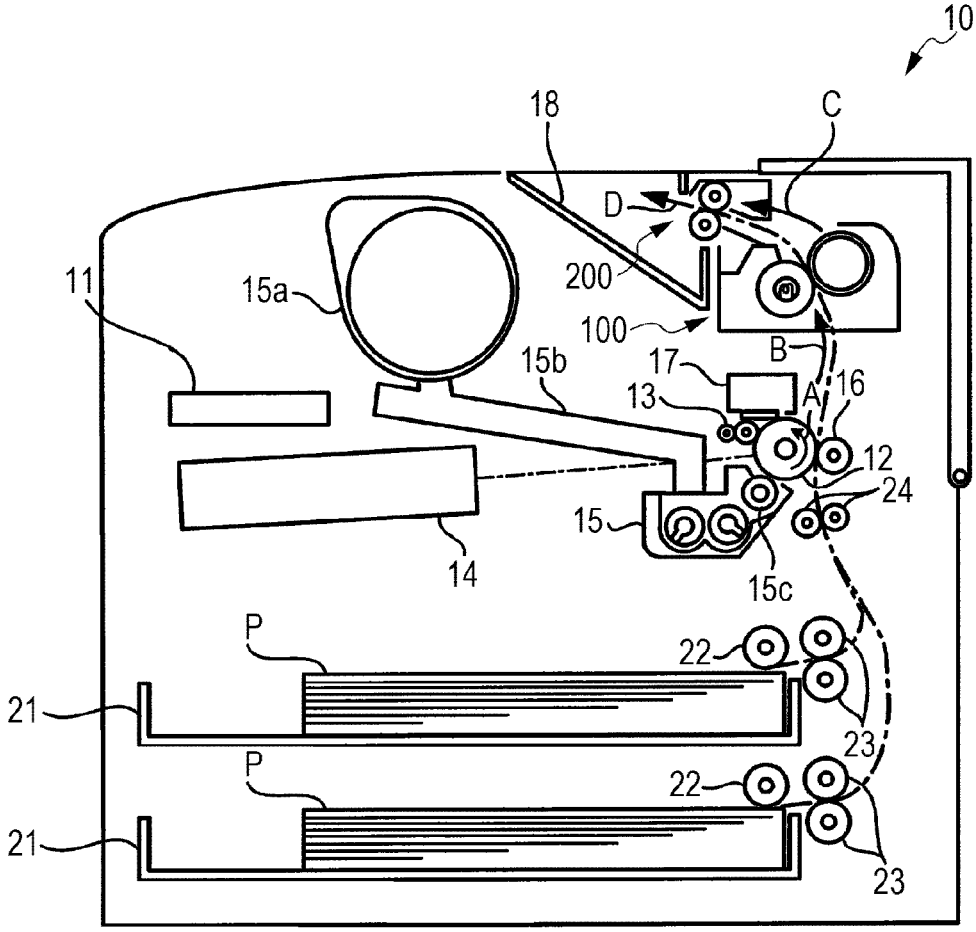
FIG. 1 schematically illustrates the configuration of a printer as an image forming apparatus according to a first exemplary embodiment of the present invention.

FIG. 1 schematically illustrates the configuration of a printer as an image forming apparatus according to a first exemplary embodiment of the present invention.

A printer 10 shown in FIG. 1 is a monochrome printer, and a fixing device according to an exemplary embodiment of the present invention is incorporated in the printer 10.

The printer 10 receives an image signal, which is generated outside the printer 10 and expresses an image, via a signal cable (not shown). The printer 10 includes a controller 11 that controls the operation of each component included in the printer 10, and the aforementioned image signal is input to this controller 11. Under the control of the controller 11, the image based on the image signal is formed in the printer 10.

Two sheet feed trays 21 are accommodated in a lower area of the printer 10. The sheet feed trays 21 each accommodate therein sheets P of paper in a stacked state. The accommodated sheets P have different sizes between the two sheet feed trays 21. The sheet feed trays 21 are ejectable so that new sheets P can be supplied thereto.

From one of the two sheet feed trays 21, a corresponding pickup roller 22 feeds sheets P with dimensions suitable for the dimensions of the image expressed by the image signal input to the controller 11. The fed sheets P are separated into individual sheets by a corresponding separation roller 23. Each of the separated sheets P is transported upward so that the leading edge of the sheet P reaches a standby roller 24. The standby roller 24 has a role of transporting the sheet P while adjusting a subsequent transport timing. The sheet P that has reached the standby roller 24 is transported further while the standby roller 24 adjusts the subsequent transport timing.

In the printer 10, a photoconductor 12 that rotates in a direction indicated by an arrow A is provided above the standby roller 24. A charging device 13, an exposure device 14, a developing device 15, a transfer device 16, and a photoconductor cleaner 17 are arranged around the photoconductor 12.

The photoconductor 12 is cylindrical and extends in the depth direction in FIG. 1. The photoconductor 12 bears an electric charge when the surface thereof is electrostatically charged, and releases the electric charge when the surface is exposed to light, whereby an electrostatic latent image is formed on the surface.

The charging device 13 includes a charging roller that rotates by being in contact with the surface of the photoconductor 12. The charging roller imparts an electric charge to the surface of the photoconductor 12 so as to electrostatically charge the surface. In the charging device 13, a corona discharger not in contact with the photoconductor 12 may be employed as an alternative to the charging roller.

The exposure device 14 includes a light-emitting unit that emits laser light (exposure light) modulated in accordance with the image signal supplied from the controller 11, and a rotating polygonal mirror for scanning the laser light across the photoconductor 12. The exposure light is output from the exposure device 14. The photoconductor 12 is exposed to this exposure light so that an electrostatic latent image is formed on the surface of the photoconductor 12. As an alternative to the laser-light emission type, a light-emitting diode (LED) array having multiple LEDs arranged in the scanning direction may be employed as the exposure device 14. Furthermore, as an alternative to the exposure type, the latent-image forming unit may be of a type that uses multiple electrodes arranged in the scanning direction so as to directly form a latent image on the surface of the photoconductor 12.

The electrostatic latent image formed on the surface of the photoconductor 12 due to the surface thereof being exposed to the exposure light is subsequently developed by the developing device 15. The developing device 15 includes a developing roller 15*c*. The developing device 15 is connected to a toner container 15*a* via a toner supply path 15*b*. The developing device 15 accommodates therein a developer containing a toner and a magnetic carrier. The toner contained in the toner container 15*a* is appropriately supplied to the developing device 15 via the toner supply path 15*b*. The magnetic carrier is, for example, iron powder coated with a resin coating. The toner particles are composed of, for example, binding resin, a colorant, and a releasing agent. The developing device 15 electrostatically charges the toner and the magnetic carrier by stirring the developer having a mixture of magnetic carrier particles and toner particles. The developer in the developing device 15 is supplied to the surface of the photoconductor 12 by the developing roller 15*c* so that the latent image on the surface of the photoconductor 12 is developed by the electrostatically-charged toner in the developer, whereby a toner image is formed.

The aforementioned standby roller 24 transports the sheet P such that the sheet P reaches a position facing the transfer device 16 at a timing at which the toner image on the photoconductor 12 reaches that position. Then, the transfer device 16 transfers the toner image on the photoconductor 12 onto the transported sheet P. The transfer device 16 used may alternatively be of a type that indirectly transfers the toner image onto the transported sheet P via an intermediate transfer body.

The toner remaining on the photoconductor 12 after the toner-image transfer process is removed from the photoconductor 12 by the photoconductor cleaner 17.

A combination of the photoconductor 12, the charging device 13, the exposure device 14, the developing device 15, and the transfer device 16 corresponds to an image forming unit according to an exemplary embodiment of the present invention.

The sheet P with the toner image transferred thereto travels in a direction indicated by an arrow B and is heated and pressed by a fixing device 100, whereby the toner image is fixed onto the sheet P. As a result, an image formed of the fixed toner image is formed on the sheet P. The fixing device 100 corresponds to a fixing device according to an exemplary embodiment of the present invention.

The sheet P passing through the fixing device 100 travels toward a sheet output device 200 in a direction indicated by an arrow C, and is transported further in a direction indicated by an arrow D by the sheet output device 200 so as to be output onto a sheet output tray 18.

Figure 2:
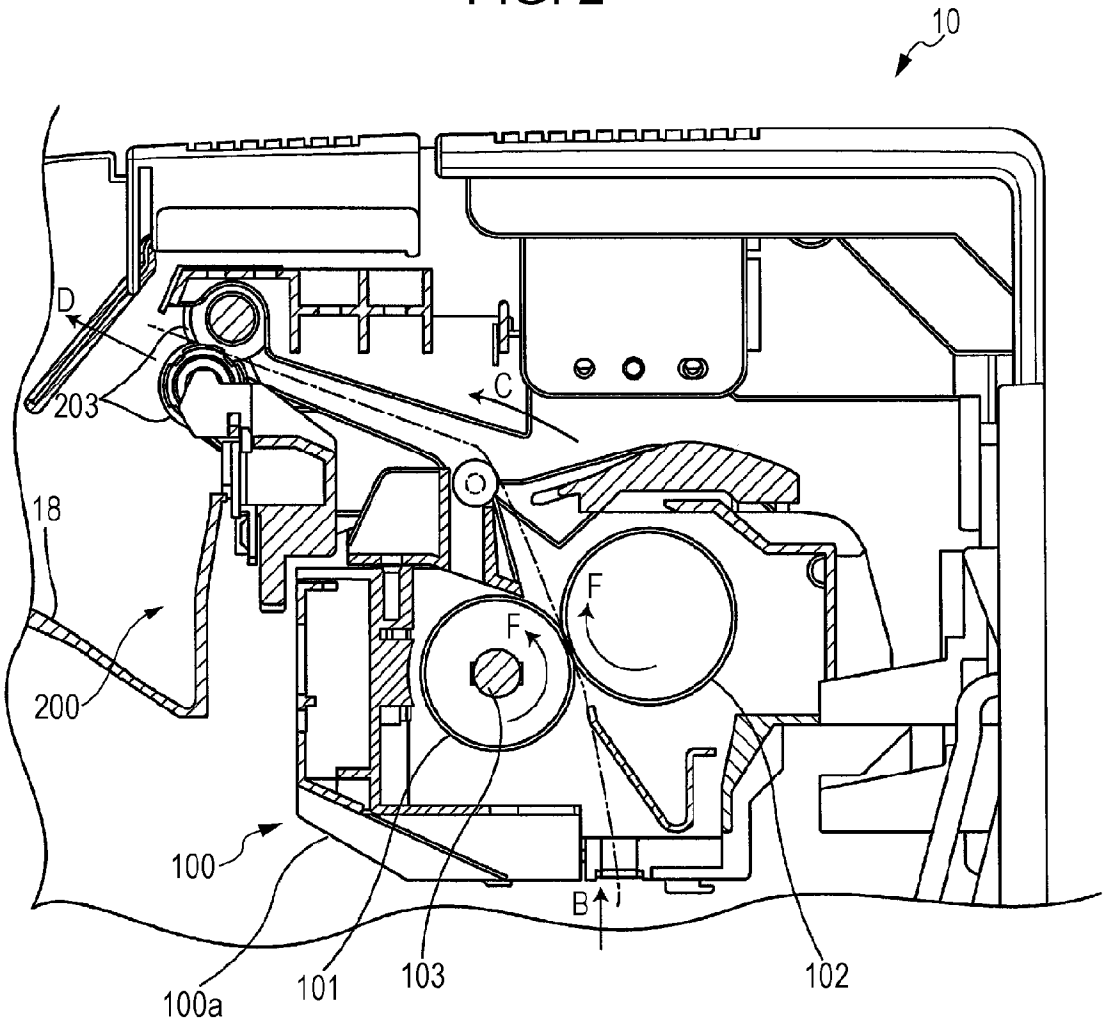
FIG. 2 is a cross-sectional view of a fixing device and a sheet output device in the printer shown in FIG. 1.

FIG. 2 is a cross-sectional view of the fixing device 100 and the sheet output device 200 in the printer 10 shown in FIG. 1.

The fixing device 100 includes a heating roller 101 and a pressing roller 102. The heating roller 101 is formed of a metallic cylinder whose outer peripheral surface is coated with a releasing material. Moreover, a heat source 103 is disposed within the heating roller 101. The pressing roller 102 is also cylindrical, and the peripheral surface of the pressing roller 102 is pressed against the peripheral surface of the heating roller 101. The sheet P that has reached the fixing device 100 by traveling in the direction of the arrow B enters a contact section between the pressing roller 102 and the heating roller 101. The sheet P is nipped between the heating roller 101 and the pressing roller 102 at the contact section. In this case, the sheet P is disposed such that the surface thereof with the toner image faces toward the heating roller 101.

The heating roller 101 and the pressing roller 102 rotate in a direction indicated by arrows F while being in contact with each other. Therefore, the sheet P entering the contact section travels through the contact section due to the rotation of the heating roller 101 and the pressing roller 102, thereby traveling toward the sheet output device 200 in the direction of the arrow C. While traveling through the contact section, the sheet P is heated by the heat source 103 disposed within the heating roller 101 and is also pressed by the pressing roller 102 so that the toner image is fixed onto the sheet P, whereby an image formed of the fixed toner image is formed on the sheet P.

The heating roller 101 corresponds to a rotating member according to an exemplary embodiment of the present invention. The pressing roller 102 corresponds to a pressing member according to an exemplary embodiment of the present invention. The heat source 103 corresponds to a heat source according to an exemplary embodiment of the present invention.

The sheet output device 200 is provided with a sheet output roller 203 that continuously transports the sheet P entering the sheet output device 200 in the direction of the arrow C and then further transports the sheet P in the direction of the arrow D. The sheet output roller 203 transports the sheet P in the direction of the arrow D from the sheet output device 200 so as to output the sheet P onto the sheet output tray 18.

The heating roller 101 will now be described in detail.

Figure 3:
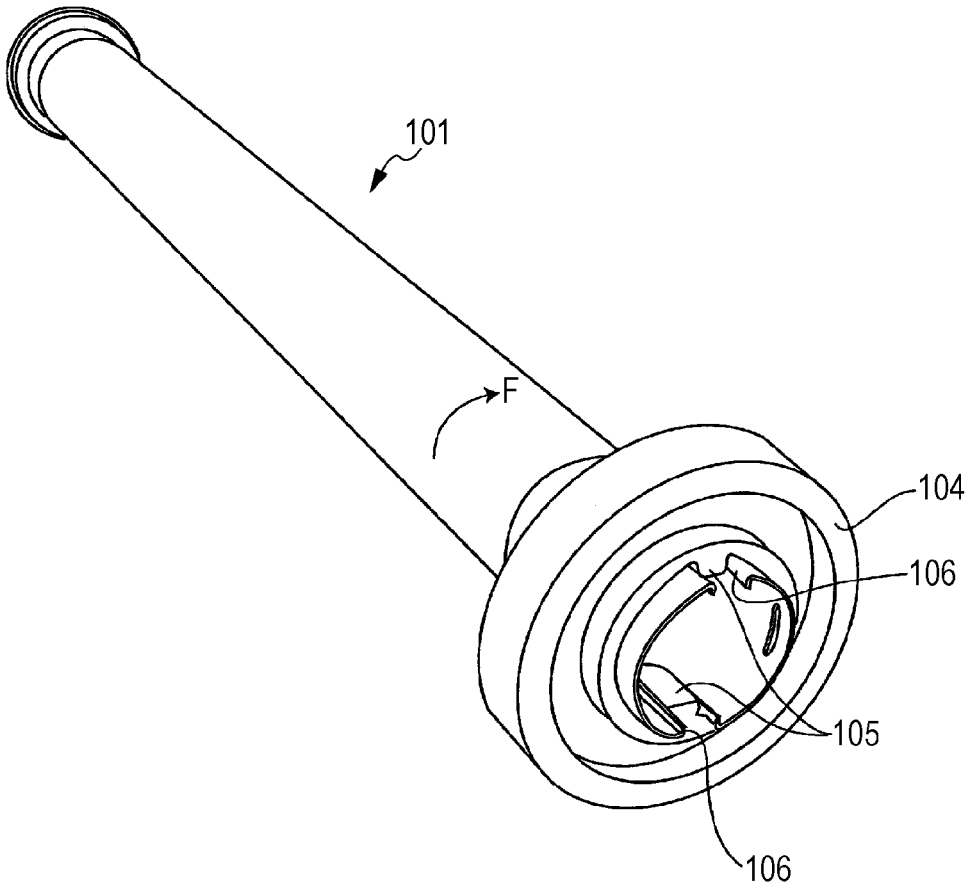
FIG. 3 is a perspective view illustrating a heating roller.

FIG. 3 is a perspective view illustrating the heating roller 101.

A drive gear 104 that rotationally drives the heating roller 101 is fitted around one end of the heating roller 101. The drive gear 104 has teeth (not shown) arranged therearound and receives a driving force from a motor via the teeth. Furthermore, the drive gear 104 is provided with inwardly-protruding keys 105. The keys 105 are engaged with keyways 106 provided at the end of the heating roller 101. The driving force received by the drive gear 104 from the motor is transmitted to the heating roller 101 via the keys 105, so that the heating roller 101 receives the driving force at the keyways 106. The heating roller 101 rotates in the direction of the arrow F due to the driving force.

The drive gear 104 corresponds to a driving member according to an exemplary embodiment of the present invention. The keys 105 correspond to engagement sections according to an exemplary embodiment of the present invention. The keyways 106 correspond to slots in the rotating member according to an exemplary embodiment of the present invention.

As demands for increasing the processing speed in image forming apparatuses are growing in recent years, it is desirable that the driving force imparted to the heating roller 101 by the drive gear 104 be maximized. Therefore, it is also desirable that the heating roller 101 have enough strength to withstand such a driving force. In order to increase the strength of the heating roller 101 to withstand the driving force, it is particularly desirable that the keyways 106 can withstand a large force.

Figure 4:
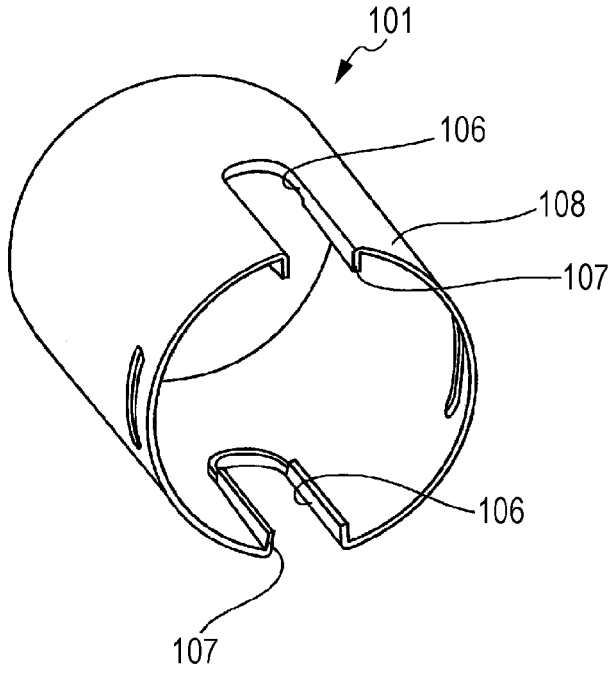
FIG. 4 illustrates the structure of keyways in the heating roller.

FIG. 4 illustrates the structure of the keyways 106 in the heating roller 101.

In FIG. 4, only the aforementioned end of the heating roller 101 is shown. The heating roller 101 is provided with a total of two keyways 106 located at half-perimeter positions of the heating roller 101. Each keyway 106 extends from the end of the heating roller 101 toward a recess thereof, and is a so-called open slot that extends through the heating roller 101 from the inside to the outside thereof. The edges of the keyway 106 are provided with protruding walls 107 formed by bending the metallic material constituting the heating roller 101. The protruding walls 107 protrude toward the inside of the heating roller 101 from a peripheral wall 108 of the heating roller 101. The protruding walls 107 correspond to protruding sections of the rotating member according to an exemplary embodiment of the present invention.

Figure 5:
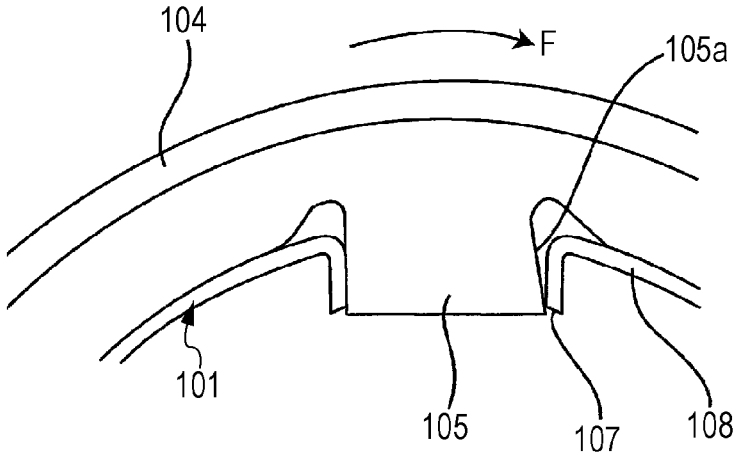
FIG. 5 illustrates a state where one of keys of a drive gear is engaged with one of the keyways in the heating roller.

FIG. 5 illustrates a state where one of the keys 105 of the drive gear 104 is engaged with one of the keyways 106 in the heating roller 101.

The rotational direction of the drive gear 104 and the heating roller 101 is the direction of the arrow F shown in FIG. 5. The key 105 of the drive gear 104 is in contact with the protruding wall 107, at the front side in the rotational direction, of the heating roller 101 at a position separated from the peripheral wall 108 by a certain distance. Therefore, a section of the protruding wall 107 from the base thereof to the contact area functions as a spring, so that stress generated due to the received driving force is dispersed. As a result, the heating roller 101 may withstand a large driving force. Specifically, in this exemplary embodiment, since a side surface 105*a* of the key 105 is in contact with an end of the aforementioned protruding wall 107, the entire protruding wall 107 functions as a spring, whereby the heating roller 101 may withstand an even larger driving force.

Based on simulation performed on the heating roller 101 having the above structure, it is confirmed that the safety factor is improved by about 1.4 to 1.9 times that of a comparative example in which the protruding walls 107 are entirely in contact with the keys 105.

Although the above exemplary embodiment relates to a monochrome printer as an example of an image forming apparatus, the image forming apparatus according to the exemplary embodiment of the present invention may be a color printer, a facsimile apparatus, a copier, or a multifunction apparatus.

Furthermore, although the image forming unit in the above exemplary embodiment of the present invention is of a type that transfers a toner image formed on a photoconductor onto a recording medium, the image forming unit according to the exemplary embodiment of the present invention may alternatively be of a type that directly forms a toner image on a recording medium.

Furthermore, although the rotating member in the above exemplary embodiment of the present invention is provided with two keyways, the rotating member according to the exemplary embodiment of the present invention may alternatively have a single keyway, or three or more keyways.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotating member that has a shape of a cylinder and rotates in a circumferential direction of the cylinder, the rotating member having a slot at an end of the cylinder and a protruding section extending along an edge of the slot at a front side in a rotational direction of the rotating member, the rotating member receiving a rotational driving force via the slot, the slot extending through the cylinder from an inside to an outside thereof and also extending from the end toward a center of the cylinder, the protruding section protruding in a direction that intersects a peripheral wall of the cylinder;

a pressing member that presses a recording medium bearing an unfixed toner image on a surface thereof by nipping the recording medium together with the rotating member so as to fix the toner image onto the surface;

a heat source that heats the recording medium nipped between the rotating member and the pressing member; and a driving member having an engagement section that is engaged with the slot in the rotating member and is in contact with the protruding section at a position separated from the peripheral wall of the cylinder by a certain distance, the driving member having a gap between the driving member and the rotating member, a portion of the gap is defined by an inner surface of the driving member that is radially outward from the peripheral wall of the cylinder and another portion of the gap is formed between the engagement portion of the driving member and an upper part of the protruding section wherein the inner surface of the driving member deviates from a cylindrical profile around the engagement portion, the driving member imparting the rotational driving force to the rotating member via the engagement section.

2. The fixing device according to claim 1, wherein a side surface of the engagement section of the driving member is in contact with an end of the protruding section of the rotating member.

3. An image forming apparatus comprising:

a fixing device that includes a rotating member that has a shape of a cylinder and rotates in a circumferential direction of the cylinder, the rotating member having a slot at an end of the cylinder and a protruding section extending along an edge of the slot at a front side in a rotational direction of the rotating member, the rotating member receiving a rotational driving force via the slot, the slot extending through the cylinder from an inside to an outside thereof and also extending from the end toward a center of the cylinder, the protruding section protruding in a direction that intersects a peripheral wall of the cylinder, a pressing member that presses a recording medium bearing an unfixed toner image on a surface thereof by nipping the recording medium together with the rotating member so as to fix the toner image onto the surface, a heat source that heats the recording medium nipped between the rotating member and the pressing member, and a driving member having an engagement section that is engaged with the slot in the rotating member and is in contact with the protruding section at a position separated from the peripheral wall of the cylinder by a certain distance, the driving member having a gap between the driving member and the rotating member, a portion of the gap is defined by an inner surface of the driving member that is radially outward from the peripheral wall of the cylinder and another portion of the gap is formed between the engagement portion of the driving member and an upper part of the protruding section wherein the inner surface of the driving member deviates from a cylindrical profile around the engagement portion, the driving member imparting the rotational driving force to the rotating member via the engagement section; and an image forming unit that forms the unfixed toner image on the surface of the recording medium.

4. A fixing device comprising:

a rotating member that has a shape of a cylinder and rotates in a circumferential direction of the cylinder, the rotating member having a slot at an end of the cylinder and a protruding section extending along an edge of the slot at a front side in a rotational direction of the rotating member, the rotating member receiving a rotational driving force via the slot, the slot extending through the cylinder from an inside to an outside thereof and also extending from the end toward a center of the cylinder, the protruding section protruding in a direction that intersects a peripheral wall of the cylinder;

a pressing member that presses a recording medium bearing an unfixed toner image on a surface thereof by nipping the recording medium together with the rotating member so as to fix the toner image onto the surface;

a heat source that heats the recording medium nipped between the rotating member and the pressing member; and a driving member having an engagement section that is engaged with the slot in the rotating member and is in contact with the protruding section at a position separated from the peripheral wall of the cylinder by a certain distance, the engagement section having a key part extending into the slot, the key part having a width that increases in a direction moving radially inward, the driving member imparting the rotational driving force to the rotating member via the engagement section.

5. The fixing device according to claim 1, where the engagement section and the protruding section comprise flat surfaces.

6. The fixing device according to claim 4, further comprising a gap between the driving member and the rotating member, a portion of the gap is defined by an inner surface of the driving member that is radially outward from the peripheral wall of the cylinder and another portion of the gap is formed between the engagement portion of the driving member and an upper part of the protruding section.

7. The fixing device according to claim 4, wherein the key part and the protruding section comprise flat surfaces.

8. The image forming apparatus according to claim 1, where the engagement section and the protruding section comprise flat surfaces.

* * * * *